US005121348A

United States Patent [19]

Dea et al.

[11] Patent Number: 5,121,348

[45] Date of Patent: Jun. 9, 1992

[54] BROAD-BAND PROGRAMMABLE HARMONICS GENERATOR

[75] Inventors: Jack Y. Dea, San Diego; James L. Conrath, Coronado; Roger Hall, La Mesa; Roger K. Cernius, El Cajon, all of Calif.

[73] Assignee: The United States of America as represented by the Secretary of the Navy, Washington, D.C.

[21] Appl. No.: 401,209

[22] Filed: Aug. 31, 1989

[51] Int. Cl.[5] ..... G06J 1/00

[52] U.S. Cl. ..... 364/607; 328/14

[58] Field of Search ..... 364/607, 718; 328/14, 328/18; 331/78

[56] References Cited

U.S. PATENT DOCUMENTS 4,283,768 8/1981 Scott .
4,346,448 8/1985 Insam et al. .
4,556,869 12/1985 Thompson .
4,823,090 4/1989 Coleman et al. .
4,882,551 11/1989 Singer ..... 331/78

*Primary Examiner*—Mark Hellner
*Attorney, Agent, or Firm*—Harvey Fendelman; Thomas Glenn Keough

[57] ABSTRACT

A simulator generates a simulated broad-band signal that may include up to and in excess of 150 harmonics for communication and signal processing applications. Clock signals are fed to a number of counters which cyclically address an EPROM storage that provides a digital waveform pre-programmed as to bandwidth and harmonic content. The digital pre-programmed waveform is fed to a digital to analog converter having a high bit resolution, in excess of 14 bits, so that a broad-band signal having 150 or more harmonics can be accurately generated. The EPROMs may be reprogrammed in accordance with a desired output signal to give a considerable flexibility with regard to bandwidth and harmonic content.

10 Claims, 4 Drawing Sheets

BROAD-BAND PROGRAMMABLE HARMONICS GENERATOR

STATEMENT OF GOVERNMENT INTEREST

The invention described herein may be manufactured and used by or for the Government of the United States of America for governmental purposes without the payment of any royalties thereon or therefore.

BACKGROUND OF THE INVENTION

Communications and signal processing requirements have changed greatly over the years due to a number of factors, such as the increasing information content, data resolution requirements and the wide variety of applications for the data. The associated equipments must be tested and evaluated more frequently to make certain that they are performing satisfactorily for their more highly sophisticated processing tasks. As a consequence, more complex signal generators and signal simulations are needed to give designers and technicians an accurate portrayal of some systems' actual capabilities. Heretofore a finite number of frequency synthesizers generated individual harmonics. Bandwidth simulations in the neighborhood of two kilohertz or less were found to need only four or five synthesizers for some purposes. The capability for extremely wide bandwidth testing realistically could not be provided for since a multitude of individual synthesizers would be required. Furthermore, a different harmonic content would require a different set of synthesizers. Many on the job test scenarios could not tolerate this burden because of the excessive bulk of equipment.

Thus, a continuing need exists in the state of the art for a extremely broad-band synthesizer having the capability of generating greater than 150 harmonics for the simulation or generation of the desired broad-band signal.

SUMMARY OF THE INVENTION

The present invention is directed to providing a broad-band simulator capable of generating in excess of 150 harmonics. A clock actuates a counter that recyclably actuates an EPROM to provide signals for a digital-to-analog converter having at least a 14 bit resolution to generate simulations from 14 to 60 kilohertz with at least 150 harmonics.

An object of the invention is to provide a broad-band programmable signal generator.

Another object is to provide a broad-band signal source capable of generating a considerable number of harmonics.

Still another object is to provide a broad-band harmonics generator having the capability for varying its content and bandwidth.

Still further object of the invention is to provide for an integrated circuit approach to generating a selectable broad-band of selectable harmonics which is cost effective.

Still a further object of the invention is to provide for a broad-band harmonics generator that is reproducible and inherently possesses such stability to function as a standard source.

These and other objects of the invention will become more readily apparent from the ensuing specifications when taken in conjunction with the appended claims and associated drawings.

DESCRIPTION OF THE PREFERRED EMBODIMENT

Figure 1:
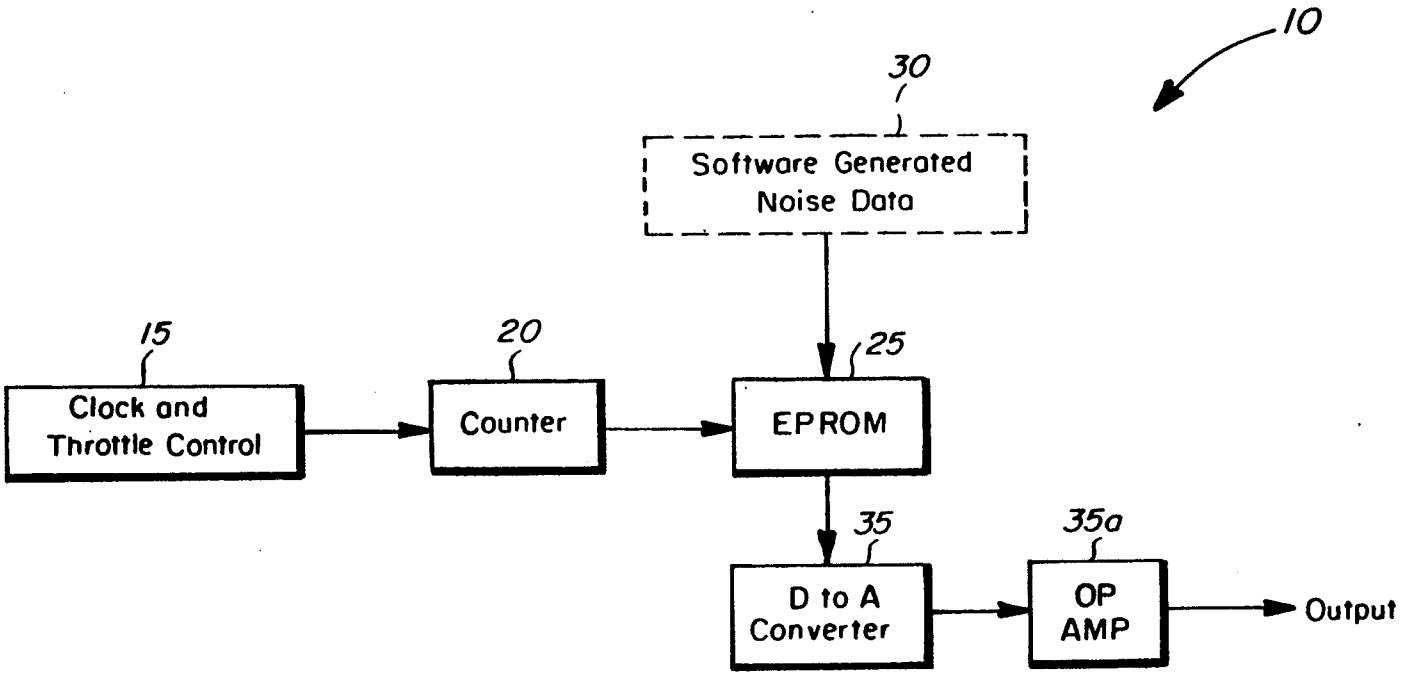
FIG. 1 is a block diagram representation of the principle constituents of the broad-band harmonics generator.

Referring now to FIG. 1 of the drawings, a broad-band programmable harmonics generator 10 is provided which give a user a considerable latitude in terms of bandwidth and frequency content of a generated signal. The compact configuration disclosed herein gives those working with the generator a greatly increased flexibility without loading them down with a massive, inflexible device.

A clock 15 is appropriately coupled to a counter stage 20 to recyclically address information in a suitable storage stage 25 such as interconnected EPROMS. The EPROMS are programmed by conventional means such as appropriate software so that digital information signals representative of an appropriate bandwidth signal with chosen harmonic content is fed to a high bit resolution digital-to-analog converter circuit 35. An operational amplifier 35*a* is provided so that the generated broad-band signal is raised to a useful level.

Figure 2:
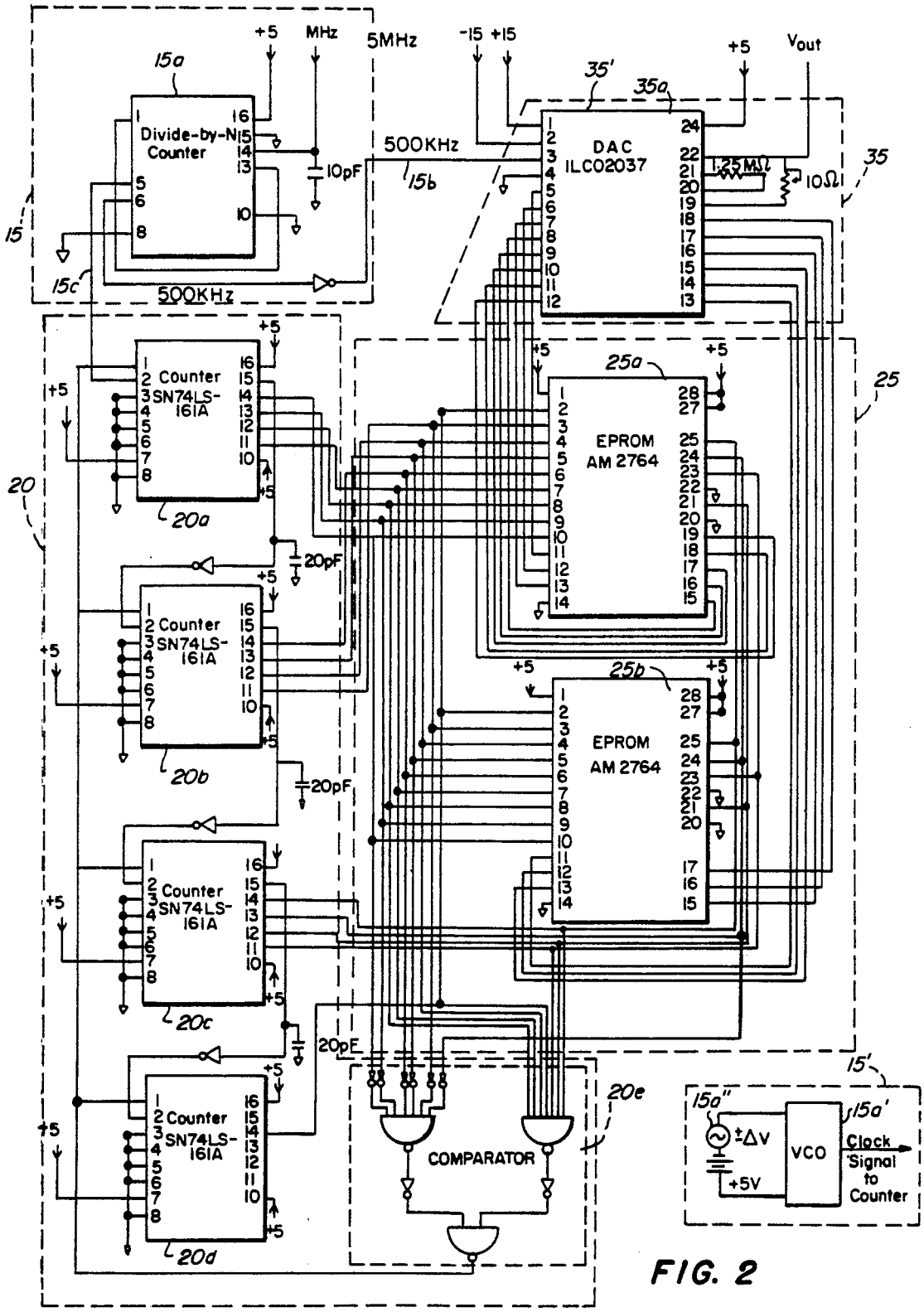
FIG. 2 is a schematical representation of a typical embodiment of the generator of the broad-band harmonics generator.

Details of the constituents are set forth in greater detail in FIG. 2. Clock 15 can include a crystal frequency source, not shown, delivering a 5 megahertz signal to a divide by n counter 15*a*. In this case the counter is a divide by 10 counter so that a 500 kilohertz signal is delivered on output leads 15*b* and 15*c*. A typical divide-by-n counter 15*a* suitable for this purpose is the RCA CD4018B that is interconnected as shown to provide the 500 kilohertz clock pulses on output leads 15*b* and 15*c*. The 500 kilohertz signal on lead 15*c* is fed to address counter stage 20.

Optionally, as shown in the lower left-hand corner of FIG. 2, an alternate clock 15' may be substituted for clock 15 and may be fabricated to include what is popularly known as a throttle control made up of a voltage control oscillator (VCO) 15*a'*, for example, fixed at 500 KHz. at 5V, and a voltage variator 15*a''*. The variator may be a slowly varying oscillator varying at a rate to simulate machinery variations. The variator varies a + and −5 volt input to the VCO. The variator modulates the input voltage to the VCO so that machinery wobble can be simulated. The variator can be any oscillator meeting the voltage (small, 1 volt) and frequency small-, < 100 Hz) requirements. An example of such an oscillator is a phase lock loop chip set to the proper frequency and volt age requirements with external components such as resistors and capacitors. The VCO is a chip which generates controlled clock pulses. The duration of the clock pulses is set by external components and input voltages that are selectable as the usage requires.

Counter stage 20 is fabricated from four appropriately interconnected counters 20*a*, 20*b*, 20*c* and 20*d*. The counters selected were TI SM74LS161As cascaded and interconnected as shown with an asynchronous clear function which was found to be essential so that the cascaded counters counted properly. The carr pulses must be inverted for the cascaded counters to count properly since using synchronous clear functions didn't work right.

The cascaded counters 20*a* through 20*d* were hard wired to a comparator circuit 20*e* which reseted the counter stage to zero after the last data address is encountered to thereby recycle the counter sequence.

Storage or EPROM stage 25 was fabricated from two appropriately interconnected EPROMS 25*a* and 25 *b*. Each of the EPROMS was an AMD AM2764 appropriately interconnected as shown to be responsive to the address sequence from counter stage 20. EPROMS 25*a* and 25 *b* had software generated data 30 burned into them via a BP Microsystems Model EP-1 EPROM Loading System. Such a system has the capability of programming EPROMS to provide a desired bandwidth with a desired harmonic content in accordance with well established procedures well known to those skilled in the art to which this invention pertains.

Digital signals representative of a desired broad-band signal having a particular harmonic content are fed to a digital-to-analog converter 35. The digital-to-analog converter (DAC) is an important design consideration. This is because the accuracy of the output waveform is highly sensitive to the capabilities of the DAC. The DAC output is deglitched so that high frequency glitches will not appear in the output. In a typical application, the DAC must be able to operate at 500 kilohertz, that is the settling time must be better than two micro seconds. The 500 kilohertz rate was arrived at to accommodate a desired bandwidth and harmonic frequency content. For example if a frequency of interest is 175 kilohertz the Nyquist criteria require that the scaling rate be two times 175 or 350 kilohertz. Data aliasing considerations scale up to a rate of 500 kilohertz. In addition the DAC must have a high resolution, that is at least a 14 to 16 bit resolution to accurately portray the desired harmonic content. These specifications pushed to the limit capabilities of some DACs and a DAC 35' by ILC Data Device Corporation, Model DAC 02307 having a 14 bit resolution provided the high resolution necessary to meet the specifications for bandwidth and harmonic content. DACs currently are available having 24 bit resolution capability and so the bandwidth and harmonic content can be much greater than the 14 to 60 KHz bandwidth with 150 harmonics as generated by the 14 bit resolution DAC by Data Device Corporation.

The real time output of the EPROMS repeats itself in periods of 0.0025 seconds (the harmonic period) at the sampling rate of 500 kilohertz, so that 1,250 points will be sampled for every harmonic period. For a 13 address bit EPROM (8192 addresses, 8 data bits each), six full data cycles of 7500 points can be programmed into the EPROM identified in the immediately preceding paragraph. The software to generate the harmonics data has already been written in accordance with capabilities well versed in the art but has to be modified by a routineer to take into account the particular bandwidth and harmonic content of a desired signal. Since 14 bit resolution is desirable to arrive at the proper harmonic content instead of a more conventional 12 bit resolution, shifted binary instead of twos complement and hexadecimal format instead of integer format are relied upon.

All the components were wire-wrapped on a common board and all are TTL compatible. DAC 35' having a self contained operational amplifier 35*a* requires a plus and minus 15 volt supply and a plus five volt supply and all the other components herein above described require a plus five volt supply.

Figure 3:
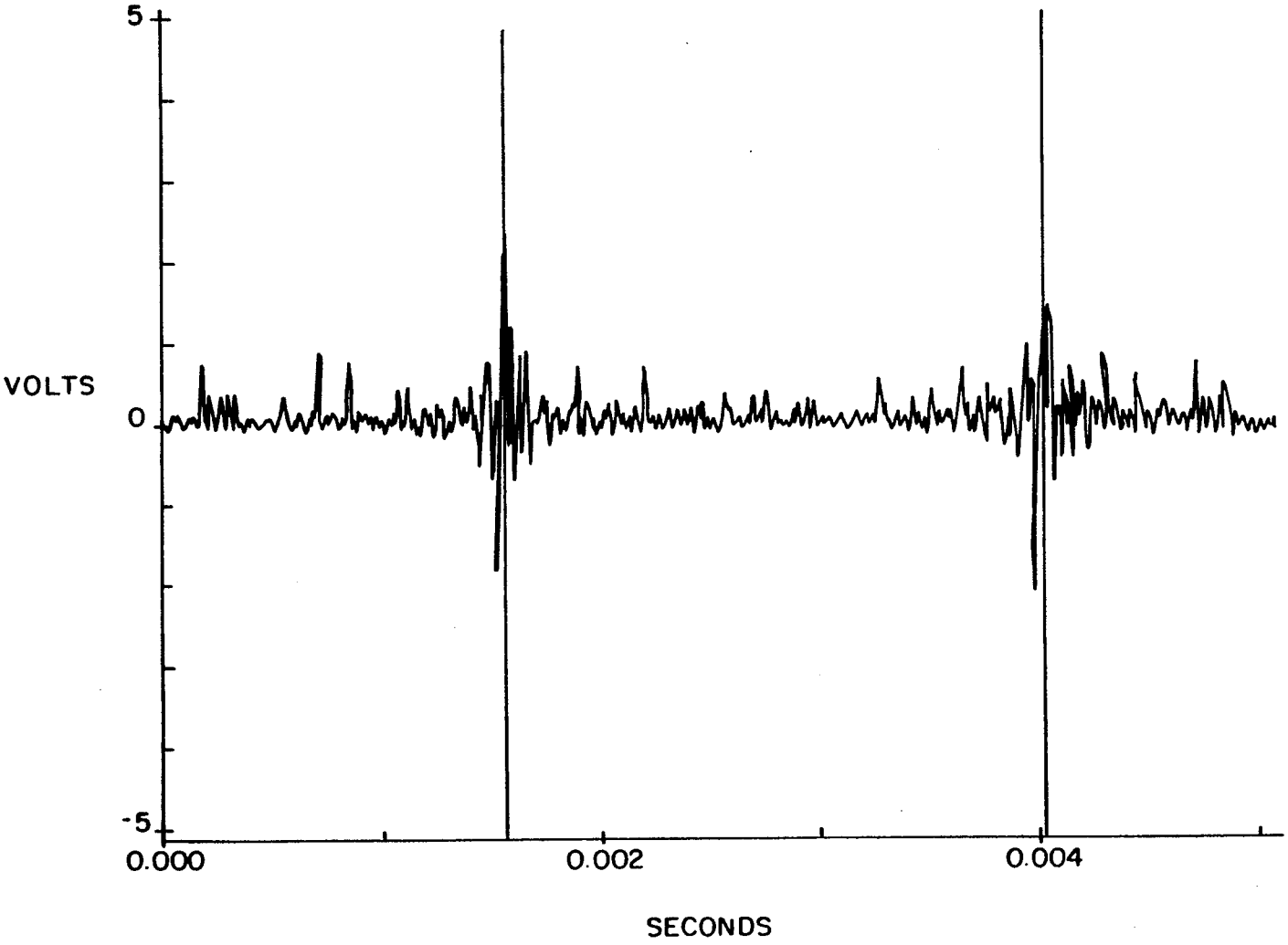
FIG. 3 depicts a representative real time output waveform of the broad-band harmonics generator.
Figure 4:
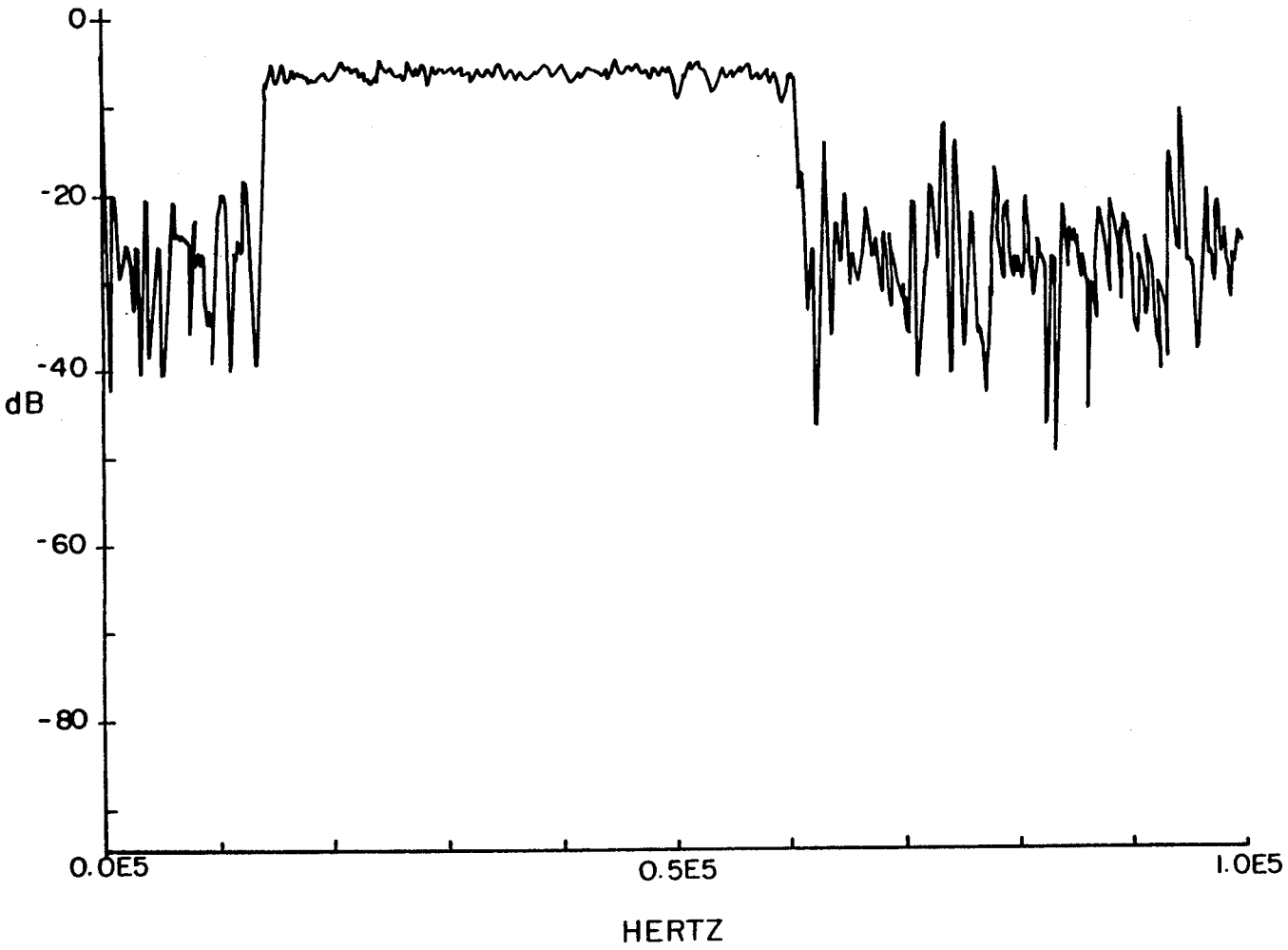
FIG. 4 represents a typical power output spectra of the broad-band harmonics generator.

A typical real time output for the broad-band programmable harmonics generator is depicted in FIG. 3. A representative waveform is shown that was monitored by a conventional spectrum analyzer such as that commercially available by Analog Data Precision Corporation. The power spectra of the generated waveform is depicted in FIG. 4. It is noted that its spectral content occupies the broad-band width from 14 kilohertz to 60 kilohertz. This broad-band signal having the desired harmonic frequency content is considerably in excess of other conventional approaches and was predetermined in exact accordance with a desired waveform.

Obviously many modifications and variations of the present invention are possible in the light of the above teachings. It is therefore to be understood that within the scope of the appended claims the invention may be practiced otherwise than as specifically described.

What is claimed:

1. An apparatus for simulating a broad band signal having a multitude of harmonics comprising:

a clock capable of generating a clock signal;

an address counter coupled to receive said clock signal to provide recycling address signals;

a programmable storage connected to said address counter to receive said recycling address signals to provide recycling preprogrammed digital signals representative of a broad band multi-harmonic signal; and an digital to-analog converter having a bit resolution of at least 14 bits coupled to said programmable storage to receive said preprogrammed digital signals to generate said broad band signal having up to 150 harmonics.

2. An apparatus for simulating a broad band signal having a multitude of harmonics comprising:

a clock capable of generating a clock signal;

an address counter coupled to receive said clock signal to provide recycling address signals;

a programmable storage connected to said address counter to receive said recycling address signals to provide recycling preprogrammed digital signals representative of a broad band multi-harmonic signal; and an digital to-analog converter having a bit resolution of at least 14 bits coupled to said programmable storage to receive said preprogrammed digital signals to generate said broad band signal having up to 150 harmonics, said address counter includes a plurality of operatively interconnected cascaded counter to provide recycling address signals and said preprogrammed storage includes at least one suitably interconnected EPROM for providing said recycling preprogrammed digital signals.

3. An apparatus according to claim 2 in which said clock is a voltage controlled oscillator interconnected to a variator for varying the rate of said clock signal to simulate machinery variations.

4. An apparatus according to claim 3 in which said analog-to-digital converter includes an operational amplifier to bring the simulated signals to the proper level.

5. An apparatus according to claim 4 in which four said cascaded counters are interconnected together to address two interconnected EPROMs to feed said recycling preprogrammed digital signals to said digital-to-analog converter.

6. An apparatus according to claim 5 in which said cascaded counters are interconnected with an asynchronous clear function which wa found to be essential for said cascaded counters to count properly.

7. An apparatus according to claim 6 in which said clock, address counter, programmable storage, and analog-to-digital converter are integrated circuits.

8. A method of simulating a broad band signal having a multitude of harmonics comprising:

generating a clock signal;

providing recycling address signals with an address counter coupled to receive said clock signal;

providing recycling preprogrammed digital signals representative of a broad band multi-harmonic signal with a programmable storage receiving said recycling address signals from said address counter; and generating said broad band signal having up to 150 harmonics in an digital-to-analog converter having a bit resolution of at least 14 bits coupled to said programmable storage in response said preprogrammed digital signals.

9. A method of simulating a broad band signal having a multitude of harmonics comprising:

generating a clock signal;

providing recycling address signals with an address counter coupled to receive said clock signal;

providing recycling preprogrammed digital signals representative of a broad band multi-harmonic signal with a programmable storage receiving said recycling address signals from said address counter; and generating said broad band signal having up to 150 harmonics in a digital-to-analog converter having a bit resolution of at least 14 bits coupled to said programmable storage in response said preprogrammed digital signals, the step of providing recycling address signals relies on said address counter including a plurality of operatively interconnected cascaded counters to provide recyling address signals and the step of providing said recycling preprogrammed digital signals relies on said preprogrammed storage including at least one suitably interconnected EPROM.

10. A method according to claim 9 in which the step of generating a clock signal relies on said clock having a voltage controlled oscillator interconnected to a variator for varying the rate of said clock signal to simulate machinery variations.

* * * * *